United States Patent [19]

Ang

[11] Patent Number: 4,620,906

[45] Date of Patent: Nov. 4, 1986

[54] MEANS AND METHOD FOR REDUCING CARBON DIOXIDE TO PROVIDE FORMIC ACID

[75] Inventor: Peter G. P. Ang, Naperville, Ill.

[73] Assignee: Texaco Inc., White Plains, N.Y.

[21] Appl. No.: 696,934

[22] Filed: Jan. 31, 1985 (Under 37 CFR 1.47)

[51] Int. Cl.[4] ..... C25B 3/00

[52] U.S. Cl. ..... 204/73 R; 204/263; 204/265; 204/283; 204/296; 429/111

[58] Field of Search ..... 204/73 R, 263, 265, 204/296, 283; 429/111

[56] References Cited

U.S. PATENT DOCUMENTS 4,240,882 12/1980 Ang et al. ..... 204/72
4,523,981 6/1985 Ang et al. ..... 429/111
4,547,273 10/1985 Ayers ..... 204/73 R

*Primary Examiner*—R. L. Andrews

*Attorney, Agent, or Firm*—Robert A. Kulason; James J. O'Loughlin; Ronald G. Gillespie

[57] ABSTRACT

A process and apparatus for reducing carbon dioxide to formic acid includes two redox couple electrolyte solutions separated by a first membrane having photosensitizers. The carbon dioxide to be reduced is provided to a second membrane which is contiguous to one of the redox couple electrolyte solutions. The second membrane has photosensitizers, a catalyst and high hydrogen overpotential material. Water provides hydrogen ions, which participate in the reduction of the carbon dioxide, via a separator. In operation both membranes are illuminated and produce excited photosensitizers which cause electron transfer from a first redox solution to a second redox solution and then to the carbon dioxide in the second membrane thereby, in cooperation with the hydrogen ions, reducing at least some of the carbon dioxide at a surface of the second membrane to provide formic acid.

45 Claims, 6 Drawing Figures

MEANS AND METHOD FOR REDUCING CARBON DIOXIDE TO PROVIDE FORMIC ACID

BACKGROUND OF THE INVENTION

Field of the Invention

The present invention relates to both photoelectrochemical catalysis and electrochemical catalysis methods and apparatus for reducing carbon dioxide to specific products.

SUMMARY OF THE INVENTION

A process and apparatus for reducing carbon dioxide to formic acid includes two individual redox electrolytes separated by a first membrane having photosensitizers. The carbon dioxide to be reduced is provided to a second membrane which is in contact to one of the redox couple electrolyte solutions. The second membrane also has photosensitizers, a catalyst with a high hydrogen overpotential. Water provides hydrogen ions, which participate in the reduction of the carbon dioxide, through the separator. In operation both membranes can be illuminated which excites the photosensitizers causing electron transfer from a first redox solution to a second redox solution and thence to the carbon dioxide in the second membrane thereby, in cooperation with the hydrogen ions, reducing at least some of the carbon dioxide at a surface of the second membrane to provide formic acid.

The objects and advantages of the invention will appear more fully hereinafter from a consideration of the detailed description which follows, taken together with the accompanying drawings wherein two embodiment of the invention are illustrated by way of example. It is to be expressly understood, however, that the drawings are for illustration purposes only and are not to be construed as defining the limits of the invention.

DESCRIPTION OF THE INVENTION

Figure 1:
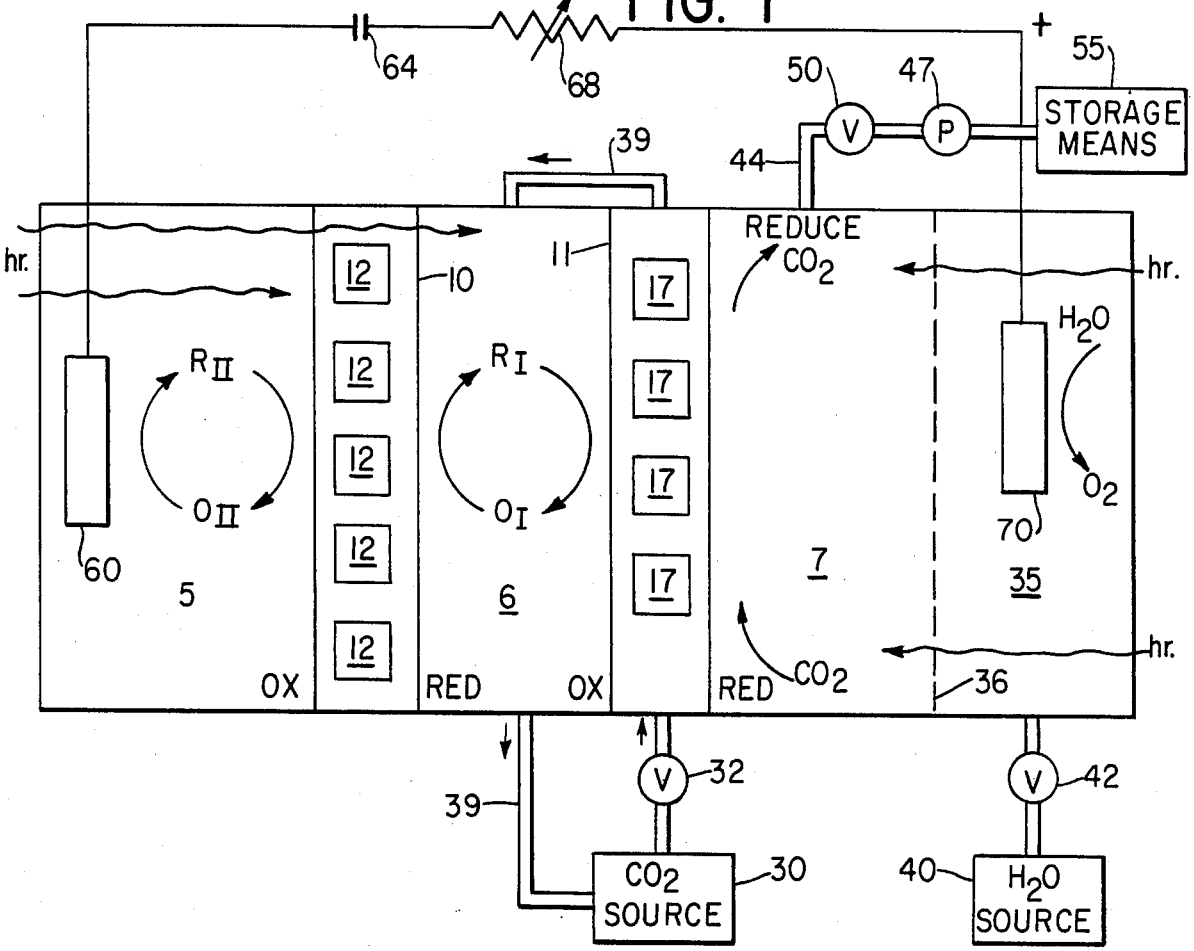
FIG. 1 is a diagrammatic representation of a photo system constructed in accordance with the present invention for reducing carbon dioxide to provide formic acid.

Referring now to FIG. 1, a photochemical reduction cell 1 made of material, which permits the passage of light while not passing an electrolyte, is divided into three chambers 5, 6 and 7 by membranes 10 and 11. Membranes 10 and 11, which may in part be made of Nafion, contain photosensitizer material represented by blocks 12 and 17, respectively. Membrane 11 will be discussed in detail hereinafter. Membrane 10 with photosensitizers 12 may be also referred to as photosystem II, while membrane 11 with photosensitizers 17 may also be referred to as photosystem I.

Figure 2:
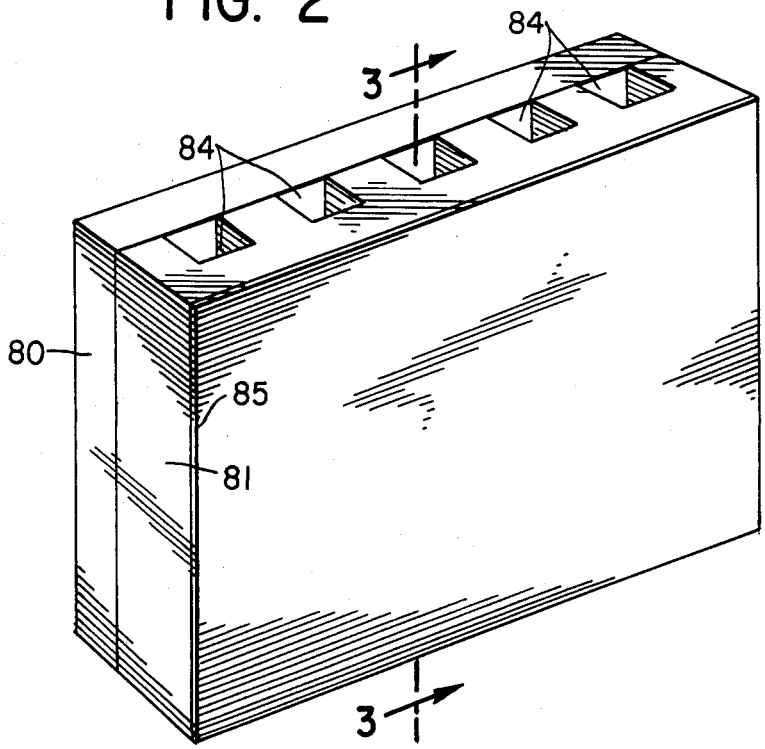
FIG. 2 is a detailed diagram of the membrane receiving carbon dioxide shown in FIG. 1.
Figure 3:
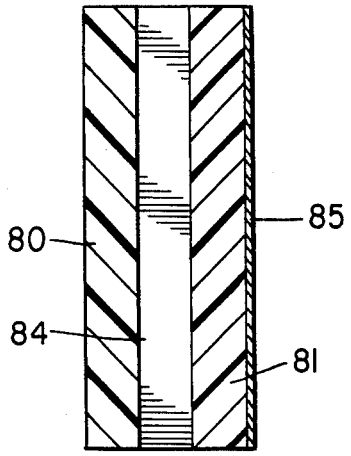
FIG. 3 is a cross-section diagram of the membrane in FIG. 2 along the line A—A.

Referring also to FIGS. 2 and 3, membrane 11 has a n-semiconductor section 80 which provides an oxidation surface to the redox electrolyte solution in chamber 6. Membrane 11 also has a hydrophobic barrier section 81 having channels 84. A surface 85 of membrane 11 contains a catalyst and high hydrogen overpotential material as hereinafter described. Membrane 11 also has, but are not shown, entrance and exit manifolds for the carbon dioxide to enter and leave membrane 11 as hereinafter explained.

Photosystem II may use photosensitizers 12 using the following semiconducting materials: n-$TiO_2$, n-$Fe_2O_3$, n-$WSe_2$, p-InP, methylene blue or porphyrins.

Chamber 5 contains an aqueous electrolyte, while chamber 6 contains another aqueous electrolyte. By way of example, the solution in chamber 5 may have a redox system $R_{II}/O_{II}$ from the following redox systems: $H_2O/O_2$, $Br^-/Br_2$, $H_2/H_2O$, methylene blue, $Fe^{+2}/Fe^{+3}$ or EDTA. Chamber 6 may have a redox system $R_I/O_I$ from the following redox systems: $I^-/I_2$, $S^2S_n^{2-}$, triethanolamine or methyl viologen.

The following table I shows preferred combinations of $R_{II}/O_{II}$, and photosystem II.

TABLE I

| $R_{II}/O_{II}$ | Photosystem II |
|---|---|
| $H_2O/O_2$ | n-$TiO_2$, n-$Fe_2O_3$ |
| $Br^-/Br_2$ | n-$WSe_2$ |
| $H_2/H_2O$ or methylene blue | p-InP |
| $Fe^{+2}/Fe^{+3}$ | methylene blue |
| EDTA | Porphyrins |

Surface 85 of membrane 11 controls the carbon dioxide reaction product. The present invention utilizes a unique manner of providing the catalyst, such as cobalt, to the photoreducing surface 85 made from p-InP material, which is followed by a subsequent deposition of a high hydrogen overpotential material which may be selected from a group of materials such as Cd, In, Sn, Hg, Tl, Sb, Bi, and Pb. The initial cobalt deposition may be done either by electrochemical or thermal vacuum evaporation techniques onto a p-InP surface to insure an effective contact for the migration of the photogenerated electron at the p-InP surface to the final lead (Pb) electron transfer site. Although several high overpotential materials may be used, greater success has been achieved with lead deposited onto cobalt. The surface of the deposits will have diameters in the 0.01 to 0.1 mm range.

Figure 5:
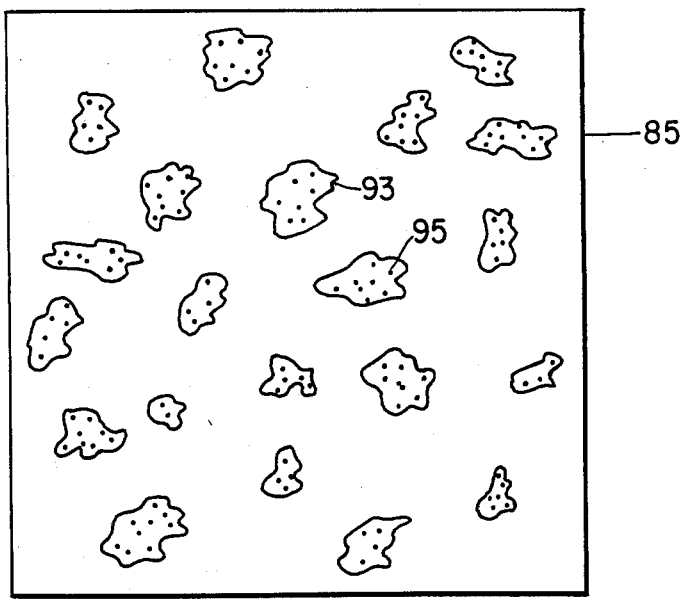
FIG. 5 is a schematic diagram of a carbon dioxide reducing surface of the system of FIG. 1, with catalyst/high hydrogen overpotential material.

With reference to FIG. 5, a preferred morphology will be the presence of the catalyst, such as cobalt, as islands 93 on p-InP surface 85 rather than as a uniform deposit. This yields a strategy for optimizing the photoelectrochemical and subsequent catalytic functions of this surface. The high hydrogen overpotential material 95 is then deposited on the cobalt islands 93 as an effective catalytic modification of the photoreducing surface 85 for the selective reduction of carbon dioxide to formic acid.

A source 30 provides $CO_2$ through a valve 32 to membrane 11 in reduction cell 1. Another chamber 35 is formed by a separator 36 which also permits the passage of light and hydrogen ions but not electrolyte. Some of the carbon dioxide passes through the hydrophobic barrier section 81 and is reduced by the hydrogen ions and the transferred electrons to a product. Unreacted carbon dioxide from membrane 11 is returned to source 30 by way of a line 39. A source 40 provides water through a valve 42 to chamber 35. The reduced $CO_2$ product is drawn off by way of a line 44 via pump 47 through a valve 50 and provided to storage means 55.

A biasing circuit may be used to improve the electron transfer. Such a circuit includes an electrode 60 which is connected to the negative terminal of a battery 64 whose positive terminal is connected to a potentiometer 68. Potentiometer 68 is connected to another electrode 70.

THEORETICAL DISCUSSION

The left surface of membrane 10 subjected to direct illumination will typically consist of an n-type semiconductor material thereby generating a negative photopotential. This negative photopotential is a result of excitation of electrons from the valence to conduction band of the semiconductor material. Electron holes left in the valence band will drive the oxidation of $R_{II} \rightarrow O_{II}$ on the illuminated side of PS II. $R_{II}/O_{II}$ represents a redox couple in the solution. Ideally, as in the case of natural photosynthesis, this couple should be $H_2O/O_2$. In practice, however, not many n-type semiconductors are stable enough to evolve oxygen. Those that can do it ($TiO_2$, $SrTiO_3$, $Fe_2O_3$) have relatively large band gaps, which means they do not absorb a major portion of sunlight. When a low band gap material such as n-$WSe_2$ is used, a redox couple such as $Br^-/Br_2$ has been found necessary to achieve semiconductor stability. Operation with $H_2O/O_2$ would lead to photocorrosion effects at the semiconductor. With the use of battery 64, potentiometer 68 and auxiliary electrode 60, the oxidized species $O_{II}$ (such as bromine) is reduced back to $R_{II}$ (such as bromide). The auxiliary electrode 70 is biased with a positive voltage so that it oxidizes water species to oxygen.

Figure 4:
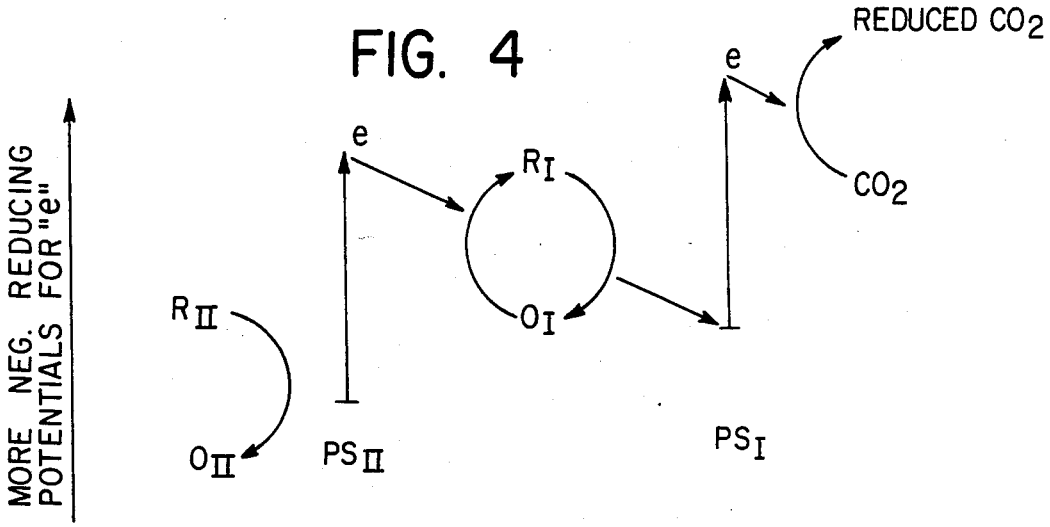
FIG. 4 is a schematic energy diagram of the electron transfer of the system shown in FIG. 1.

While an oxidation reaction occurs on the left side of PS II, a corresponding reduction reaction $O_I \rightarrow R_I$ occurs on the right side. This occurs because electrons in PS II become photoexcited to higher energy levels (i.e., more negative potentials), as shown in FIG. 4. The left side of PS I will also interact with $R_I/O_I$. Thus, $R_I/O_I$ acts like a large transfer relay. The equilibrium electrochemical potential of $R_I/O_I$ is more negative than $R_{II}/O_{II}$; consequently, when excitation of the semiconductor material corresponding to PS I occurs, its photoexcited electrons will be able to reach much higher levels compared to the photoexcitation level of PS II. Electron holes will oxidize $R_I$ to $O_I$ on the left side of PS I. On its right side, the highly energized photoexcited electrons will have the potential to reduce $CO_2$ species. However, competing reactions such as reduction of water species to hydrogen will also occur.

It is here that the role of the surface catalyst incorporating a high hydrogen overpotential material, will be important. The cobalt catalyst is modified by the high hydrogen overpotential material to inhibit a hydrogen evolution reaction. This allows more negative potentials to be realized before the inception of hydrogen evolution. This allows carbon dioxide reduction reactions to occur leading to the formation of formic acid.

For both PS I and PS II, n- or p-type semiconductor materials can be used depending upon the direction of illumination. n-type semiconductors will generate a negative photopotential, drive an oxidation reaction on its illuminated surface, and a reduction reaction on its dark side. p-Type material will generate a positive photopotential, drive a reduction reaction on its illuminated surface, and an oxidation reaction on its unilluminated side. The net effect of the overall process will be an electron movement through the photoreducing membrane from the left side to the right side. To keep electroneutrality in the system, this charge movement has to be balanced by equal migration of positive charges. Nafion membranes are good cation exchangers for species such as $H^+$. The protons will be used on the right side with $CO_2$ to produce formic acid. Thus water is consumed in the overall $CO_2$ reduction process.

Separator 36 on the right side of the cell is provided to pass the hydrogen ions while preventing intermixing of the reduced $CO_2$ species with oxygen produced at the positive auxiliary electrode. The oxygen evolved will be vented out from the system. Battery 64, potentiometer 68 and the electrodes 60 and 70 may be used to increase the current necessary for the $CO_2$ reduction process.

Figure 6:
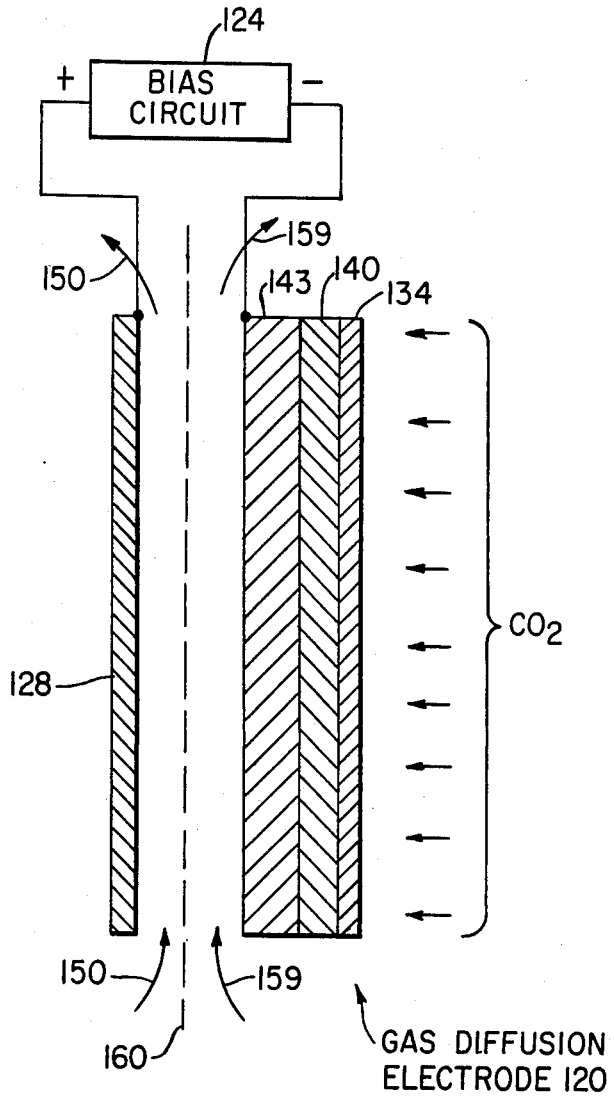
FIG. 6 is a detailed diagram with another embodiment of the present invention using a gas diffusion electrode. .

The present invention may be applied to an electrochemical process using a diffusion electrode to reduce carbon dioxide to formic acid. Referring to FIG. 6, there is shown a cutaway view of a diffusion electrode 120 cooperating with a biasing circuit 124 and a counter electrode 128 to reduce the carbon dioxide to formic acid. Gas diffusion electrode 132 in this specific example is a cathode and electrode 128 is an anode. Gas diffusion electrode 120 includes a hydrophobic diffusion region 134, a three phase reaction region 140 which includes a catalyst, preferably cobalt, on a semiconductive material, such as p-InP, and high overpotential material, such as lead, all of which is affixed to a conductive substrate 143, such as a high surface area carbon, preferably carbon XC 72.

The relationship of the p-InP, cobalt and lead has been discussed hereinbefore.

Biasing circuit 124 is electrically connected to electrode 128 and to the substrate 143 of gas diffusion electrode 120 to provide the voltage to gas diffusion electrode 120 and the electrode 128. Electrode 128 is rendered more positive than gas diffusion electrode 120 and the voltage across electrodes 120, 128 is sufficient to enhance the transfer of electrons to within the reaction region 140.

A first $R_{II}/O_{II}$ redox electrolyte 150 is provided between electrodes 120 and 128 while a second $R_I/O_I$ electrolyte 154 is also provided between electrodes 120 and 128 with the two electrolytes solutions being separated by a separator 160. The electron transfer occurs through the electrolytes 150, 154 to enter into the reaction region 140 where carbon dioxide is entering as shown in the Figure to react with the electrons to provide the formic acid.

The present invention as hereinbefore described is an improved photoelectrochemical method and apparatus for reducing carbon dioxide to formic acid in which the carbon dioxide is provided to a membrane having photosensitizers, catalyst and high hydrogen overpotential material or to a diffusion electrode having the same properties as the membrane except it need not have photosensitizers. Further, the present invention may be used in an electrochemical process without light to reduce carbon dioxide to formic acid.

What is claimed is:

1. A process for reducing carbon dioxide to provide a useful product comprising the steps of:

a. providing a $R_{II}/O_{II}$ redox coupled electrolyte solution, b. providing a $R_I/O_I$ redox coupled electrolyte solution, c. separating $R_{II}/O_{II}$ solution from the $R_I/O_I$ solution with a first membrane having photosensitizers, d. providing carbon dioxide, e. separating the carbon dioxide from the $R_I/O_I$ solution with a second membrane containing a photosensitive semiconductor material and having a catalyst and a high hydrogen overpotential material on it, f. providing water, g. separating the water from the carbon dioxide in a manner so that hydrogen ions, but not oxygen, may pass from the water to participate in the reduction of the carbon dioxide, and h. illuminating both membranes so as to produce excited photosensitizers to cause electron transfer from the $R_{II}/O_{II}$ solution to the $R_I/O_I$ solution thence to the carbon dioxide to cooperate with passed hydrogen ions in the reducing of the carbon dioxide to provide formic acid.

2. A process as described in claim 1 in which the $R_{II}/O_{II}$ redox coupled electrolyte solution is selected from a group of redox couples including $H_2O/O_2$, $Br^-/Br_2$, methylene blue, $Fe^{+2}/Fe^{+3}$ and EDTA.

3. A process as described in claim 2 in which the first membrane's photosensitizer is selected from a group of photosensitizers including n-$TiO_2$, n-$Fe_2O_3$, n-$WSe_2$, p-InP, methylene blue and porphyrins.

4. A process as described in claim 3 in which the $R_I/O_I$ redox coupled electrolyte solution is selected from a group of redox couples including $I^-/I_2$, $S^{2-}/S_n^{2-}$, triethanolamine and methyl viologen.

5. A process as described in claim 1 in which the second membrane includes:

photosensitive material, a catalyst distributed over one surface of the photosensitive material, and a high hydrogen overpotential material distributed over the catalyst.

6. A process as described in claim 5 in which the photosensitive material of the second membrane is p-InP.

7. A process as described in claim 5 in which the catalyst is cobalt.

8. A process as described in claim 7 in which the cobalt is uniformly distributed over the surface of the photosensitive material of the second membrane.

9. A process as described in claim 7 in which the cobalt is deposited in the form of islands on the surface of the photosensitive material of the second membrane.

10. A process as described in claim 8 in which the photosensitive material of the second membrane is p-InP.

11. A process as described in claim 9 in which the photosensitive material of the second membrane is p-InP.

12. A process as described in claim 5 in which the high hydrogen overpotential material is selected from Cd, In, Sn, Hg, Tl, Sb, Bi, and Pb.

13. A process as described in claim 12 in which the high hydrogen overpotential material is Pb.

14. A process for reducing carbon dioxide to provide a useful product comprising the steps of:

a. providing a $R_{II}/O_{II}$ redox coupled electrolyte solution, b. providing carbon dioxide, c. separating the carbon dioxide from the $R_{II}/O_{II}$ solution with first and second membranes having photosensitizers and the second membrane is in contact with the carbon dioxide and has a catalyst and high hydrogen overpotential material on top of the catalyst, d. electrically connecting the first membrane to the second membrane, e. providing water, f. separating the water from the carbon dioxide in a manner so that hydrogen ions, but not oxygen, may pass from the water to participate in the reduction of the carbon dioxide, and g. illuminating both membranes so as to produce excited photosensitizers to cause electron transfer from the $R_{II}/O_{II}$ solution to the carbon dioxide to cooperate with passed hydrogen ions in reducing the carbon dioxide to provide at least one product.

15. Apparatus for reducing carbon dioxide to provide formic acid comprises:

means for containing a first redox coupled electrolyte solution, means for containing a second redox coupled electrolyte solution, first means responsive to illumination for transferring electrons from the first electrolyte solution to the second electrolyte solution, said first electron transfer means is a membrane having photosensitizers, means for containing water, means for containing carbon dioxide, means for providing hydrogen ions from the water to the carbon dioxide, and second means responsive to illumination for transferring electrons from the second electrolyte to the carbon dioxide where the transferred electrons and the hydrogen ions cooperate to reduce the carbon dioxide to provide at least one product, said second electron transfer means is a membrane having photosensitizers, a catalyst and a high hydrogen overpotential material.

16. Apparatus as described in claim 15 in which the first redox coupled electrolyte solution is selected from a group of redox couples including $H_2O/O_2$, $Br^-/Br_2$, methylene blue, $Fe^{+2}/Fe^{+3}$ and EDTA.

17. Apparatus as described in claim 16 in which the first membrane's photosensitizer is selected from a group of photosensitizers including n-$TiO_2$, n-$Fe_2O_3$, n-$WSe_2$, p-InP, methylene blue and porphyrins.

18. Apparatus as described in claim 17 in which the second redox coupled electrolyte solution is selected from a group of redox couples including $I^-/I_2$, $S^{2-}/S_n^{2-}$, triethanolamine and methyl viologen.

19. Apparatus as described in claim 18 in which the second membrane includes:

photosensitive material, the catalyst distributed over one surface of the photosensitive material, and the high hydrogen overpotential material distributed over the catalyst.

20. Apparatus as described in claim 19 in which the photosensitive material of the second membrane is p-InP.

21. Apparatus as described in claim 19 in which the catalyst is cobalt.

22. Apparatus as described in claim 21 in which the cobalt is uniformly distributed over the surface of the photosensitive material of the second membrane.

23. Apparatus as described in claim 21 in which the cobalt is deposited in the form of islands on the surface of the photosensitive material of the second membrane.

24. Apparatus as described in claim 22 in which the photosensitive material of the second membrane is p-InP.

25. Apparatus as described in claim 23 in which the photosensitive material of the second membrane is p-InP.

26. Apparatus as described in claim 19 in which the high hydrogen overpotential material is selected from Cd, In, Sn, Hg, Tl, Sb, Bi, and Pb.

27. Apparatus as described in claim 26 in which the high hydrogen overpotential material is Pb.

28. Apparatus as described in claim 19 in which a biasing voltage is provided across the first electrolyte solution and the water in a manner so that the water is anodically biased relative to the first electrolyte solution.

29. Apparatus as described in claim 28 in which the illumination is achieved by solar radiation.

30. A membrane for use in the electrophotochemical reduction of carbon dioxide to formic acid comprising:
- photosensitive material,
- a catalyst distributed over one surface of the photosensitive material, and
- a high hydrogen overpotential material distributed over the catalyst.

31. A membrane as described in claim 30 in which the photosensitive material is p-InP.

32. A membrane as described in claim 30 in which the catalyst is cobalt.

33. A membrane as described in claim 32 in which the cobalt is uniformly distributed over the surface of the photosensitive material.

34. A membrane as described in claim 32 in which the cobalt is deposited in the form of islands on the surface of the photosensitive material.

35. A membrane as described in claim 33 in which the photosensitive material is p-InP.

36. A membrane as described in claim 34 in which the photosensitive material is p-InP.

37. A membrane as described in claim 30 in which the high hydrogen overpotential material is selected from Cd, In, Sn, Hg, Tl, Sb, Bi, and Pb.

38. A membrane as described in claim 37 in which the high hydrogen overpotential material is Pb.

39. A gas diffusion electrode comprising:
- means for transferring electrons,
- hydrophobic means for passing carbon dioxide but not hydrogen, and
- means for reducing carbon dioxide that has passed through the hydrophobic means to formic acid with the cooperation of transferred electrons.

40. A gas diffusion electrode as described in claim 39 in which the reducing means includes:
- semiconductor material,
- a catalyst, and
- a high hydrogen overpotential material.

41. A gas diffusion electrode as described in claim 40 in which the semiconducting material is p-InP, the catalyst is cobalt, and the high hydrogen overpotential material is lead.

42. Electrochemical apparatus for reducing carbon dioxide to formic acid comprising:
- an electrode forming one side of flowing $R_I/O_I$ and $R_{II}/O_{II}$ electrolyte chamber,
- a gas diffusion electrode forming the opposite side of said electrolyte chamber, and including
- means for transferring electrons,
- hydrophobic means for passing carbon dioxide but not hydrogen, and
- reducing means for reducing carbon dioxide that has passed through the hydrophobic means to formic acid with the cooperation of transferred electrons,
- said $R_I/O_I$ and $R_{II}/O_{II}$ electrolytes within said electrolyte chamber capable of providing ionic conductance between said electrode and said gas diffusion electrode,
- said electrolyte chamber having an ionic conducting separator for chemical separation of one electrolyte from the other electrolyte, and
- biasing means for providing a biasing voltage across said electrode and said gas diffusion electrode to cause electron transfer to the reducing means.

43. Apparatus as described in claim 42 in which the reducing means includes:
- semiconductor material,
- a catalyst, and
- a high hydrogen overpotential material.

44. Apparatus as described in claim 40 in which the semiconducting material is p-InP, the catalyst is cobalt, and the high hydrogen overpotential material is lead.

45. Apparatus as described in claim 44 in which the $R_{II}/O_{II}$ redox coupled electrolyte is selected from a group of redox couples including $H_2O/O_2$, $Br^-/Br_2$, $H_2/H_2O$, methylene blue, $Fe^{+2}/Fe^{+3}$ or EDTA and the $R_I/O_I$ electrolyte is selected from the following redox couples: $I/I_2$, $S^2S_n^2$, triethanolamine or methyl viologen.

* * * * *